US008201482B2

(12) United States Patent
Vossen

(10) Patent No.: US 8,201,482 B2
(45) Date of Patent: Jun. 19, 2012

(54) DEVICE FOR PUNCHING BLANKS OUT OF A FLAT SHEET

(76) Inventor: Franz Vossen, Wahlwies (DE)

( * ) Notice: Subject to any disclaimer, the term of this patent is extended or adjusted under 35 U.S.C. 154(b) by 0 days.

(21) Appl. No.: 10/535,987

(22) PCT Filed: Nov. 20, 2003

(86) PCT No.: PCT/EP03/13005
§ 371 (c)(1),
(2), (4) Date: Dec. 30, 2005

(87) PCT Pub. No.: WO2004/045811

PCT Pub. Date: Jun. 3, 2004

(65) Prior Publication Data

US 2006/0112803 A1 Jun. 1, 2006

(30) Foreign Application Priority Data

Nov. 21, 2002 (DE) ..... 202 18 147 U
Feb. 7, 2003 (DE) ..... 203 01 871 U

(51) Int. Cl.
*B26D 7/00* (2006.01)

(52) U.S. Cl. ..... 83/55; 83/111; 83/139; 83/142; 83/145; 76/107.8

(58) Field of Classification Search ..... 83/862, 83/55, 656, 658, 697, 879, 883, 111, 113, 83/117, 124–126, 128, 136, 138, 139, 142, 83/145, 27; 493/354–356; 76/107.8
See application file for complete search history.

(56) References Cited

U.S. PATENT DOCUMENTS

| | | | | | |
|---|---|---|---|---|---|
| 2,402,223 | A * | 6/1946 | Wright | 166/173 |
| 2,458,867 | A * | 1/1949 | Messersmith | 76/107.8 |
| 2,714,500 | A * | 8/1955 | Snyder | 175/323 |
| 3,277,756 | A * | 10/1966 | Des Jardins et. al. | 83/116 |
| 3,288,007 | A * | 11/1966 | Masumi et al. | 83/117 |
| 3,827,322 | A * | 8/1974 | Saunders et al. | 83/128 |
| 5,176,613 | A * | 1/1993 | Cavlin et al. | 493/354 |
| 5,582,571 | A * | 12/1996 | Simpson et al. | 493/355 |
| 6,203,482 | B1 * | 3/2001 | Sandford | 493/61 |
| 6,280,373 | B1 * | 8/2001 | Lanvin | 493/227 |
| 6,644,153 | B1 * | 11/2003 | Gordon | 83/27 |

* cited by examiner

*Primary Examiner* — Phong Nguyen
(74) *Attorney, Agent, or Firm* — Bachman & LaPointe, P.C.

(57) ABSTRACT

A device for punching blanks out of a flat sheet, in particular packaging blanks consisting of cardboard or corrugated cardboard, using a punching tool that is mounted in a carrier plate and projects beyond the plate in the form of a blade or cutting line, in addition to profiled strips, consisting of a material of limited flexibility, which flank the tool. A rail-type profiled channel consisting of a rigid material is located on the carrier plate, running parallel to the punching tool on each side of the longitudinal faces of the latter and one cross-sectional area of the profiled strip is inserted into the profiled channel in a positive fit. In addition, at least one lateral face of the cross-section of the profiled strip has a protuberant base.

18 Claims, 2 Drawing Sheets

20
26
30
22
40
46
36
47
50
48
10
24
M
34
32
49
a
q
c
h

M
46
39
38
44
42
40
36
48
49
c
h 20
22
40
47
50
49
30
34
46
10
x 40a
39
38
M
36a
47a
50a
49
42
44
37
c

DEVICE FOR PUNCHING BLANKS OUT OF A FLAT SHEET

BACKGROUND OF THE INVENTION

The invention relates to a device for punching blanks out of a flat sheet, in particular packaging blanks consisting of cardboard or corrugated cardboard, by means of a punching tool which is mounted in a carrier plate and projects beyond said plate in the form of a blade or cutting line, and also profiled strips consisting of a material of limited flexibility which flank said tool.

Such devices, in which the tools made of steel strip slide along lateral profiled strips consisting of rubber or flexible plastic, are known in the packaging industry. These profiled strips are either adhesively bonded over their surface to the carrier plate—which is made of plywood for example—or are inserted by beads made in them into grooves of the carrier plate. Laser cuts are made in said plywood plate in order to accommodate so-called cutting lines.

By virtue of this device, packaging blanks can be cut in groups out of a cardboard or corrugated cardboard sheet. The punching machine processes the so-called printed sheets in a cyclical manner; the cutting contours and scoring lines are mainly produced in the punching section thereof.

In order to further transport the punched sheet, so-called supporting points are required which hold the individual packagings together, said packagings also being referred to as copies. When the cutting lines penetrate into the sheet material, very high wedge forces develop which try to destroy the supporting points. By applying the abovementioned elastic profiled strips which run on either side of the punching tool, by virtue of the elastic pressure coming therefrom a higher frictional resistance is produced between the underside of the punched sheet and the surface of the punching plate, and this prevents bursting of the supporting points. The cross section of the elastic profiled strip should in this case be selected such that forces additionally act in the direction of the tool.

One disadvantage of systems known to date is that the profiled strip has to be removed in the event of tool repairs or when forming supporting points. This is difficult in particular since the wood breaks open and profiled parts remain on the wood, and this necessitates cleaning of the surface. Moreover, the base of the profiled strip is lost and the new profiled strips must be inserted, wherein the curing time of the adhesive gives rise to a downtime of the machine.

Knowing these conditions, the inventor set himself the aim of eliminating the known drawbacks, of simplifying the handling of the machine parts and of achieving an improvement in terms of production.

SUMMARY OF THE INVENTION

According to the invention, a channel-like profile consisting of rigid material is arranged on the carrier plate parallel to the punching tool on each of the longitudinal sides thereof, and the profiled strip is inserted with the ridge region of its cross section into said channel-like profile; it is therefore not directly connected to the carrier plate, said carrier plate preferably being formed of a multilayer plywood plate. To this end, it has proven to be advantageous to accommodate the profiled strip in the rail-type channel profile in a form-fitting manner, so that it can be removed without damage.

According to another feature of the invention, the cross section of the profiled strip has an outwardly directed base bead at least on one side surface; the punching tool should be flanked on either side by in each case one lateral base bead of the profiled strips. The side surfaces of the profiled strip—which are defined by an almost linear contour—may however also be inclined inwards towards the profile centre line. The choice of this shape depends on the use purpose of the profiled strip.

In all cases, it is advantageous if the profile centre line of the profiled strip is the line of symmetry thereof.

It is within the scope of the invention that the rail-type channel profile is provided with an inner undercut space—which receives a correspondingly shaped region of the profiled strip—on its channel legs which project from a ridge plate; said undercut space may be produced by the inner faces of the channel legs being curved inwards in cross section or by channel legs which are angled in cross section and have hook bars at their ends, said hook bars pointing towards one another.

In order to simplify the fixing of the channel profile to the carrier plate, the ridge plate of said channel profile is to be fixed to the wood of the punching die by liquid adhesive. However, the ridge plate may also be provided with an adhesive layer on the outside, which adhesive layer may moreover be covered by a covering layer when not in use; when the covering layer is pulled off, said adhesive layer is freely available as a connecting element.

According to a further feature of the invention, the plate-shaped punching tool, at a distance from the adjacent channel legs of the channel profiles, is provided with a cutting edge which points away from the latter, and said cutting edge is provided with notches made at a distance from one another; by virtue of the inclusion of these cutting lines, the abovementioned supporting points are automatically produced at specific locations during the punching operation. In a cutting line produced in the sheet, the notches define the supporting points for adjacent copies.

It is ideal if the profiled strip completely fulfils its function during the punching operation and nevertheless is easy to remove and replace. This is ensured by the above-described rail in the form of a channel profile which is adhesively bonded to the wood of the punching die; this also secures the position of the profiled strip which consists of rubber or a similar elastic material. Moreover, rapid replacement with other strip types is readily possible, for example with a softer rubber.

BRIEF DESCRIPTION OF THE DRAWINGS

Further advantages, features and details of the invention emerge from the following description of preferred examples of embodiments and with reference to the drawing; in the drawing.

DETAILED DESCRIPTION

Figure 1:
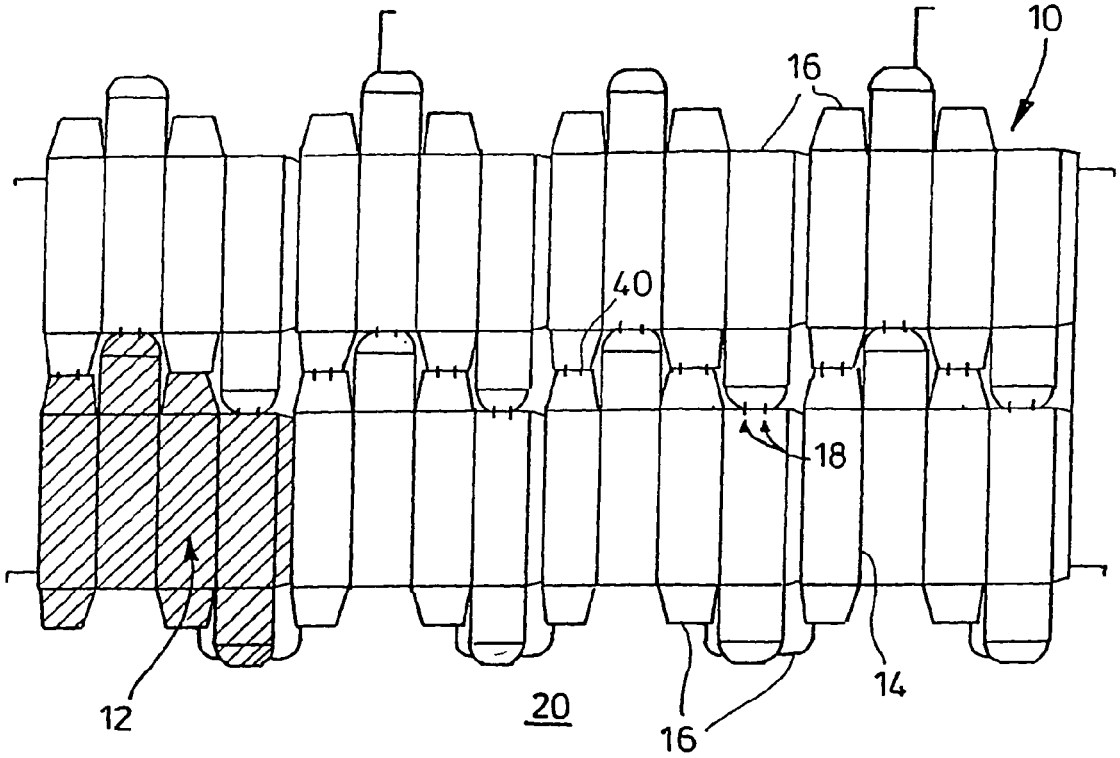
FIG. 1 shows a plan view of a punching die of a punching machine with folded box blanks lying thereon.

In order to punch packagings out of cardboard or corrugated cardboard, a sheet 10 of this material is fed for example to a flat bed punching machine; the sheet 10 exhibits the contours of eight adjoining blanks 12 for folded box; through these blanks 12, cyclic punching operations are to be carried out and have scoring lines 14—which define the subsequent folding operation—and also cutting lines 16 as cutting contours which define the outside. Adjacent cutting lines 16 are connected by pairs of so-called supporting points 18; the latter are necessary for further transporting the punched sheet 10 in the punching machine 20.

Figure 2:
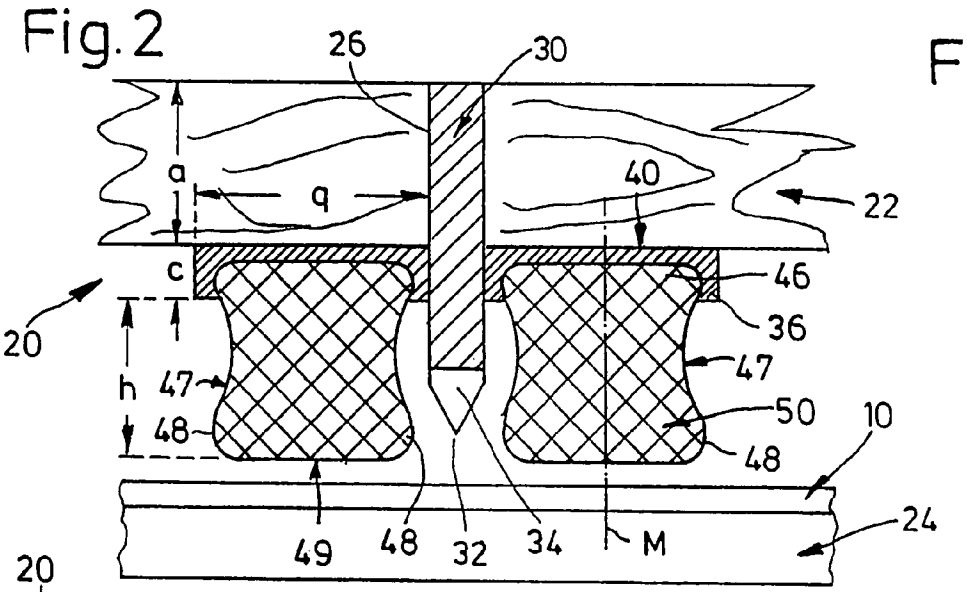
FIGS. 2, 5 show details of a punching operation on an enlarged scale compared to FIG. 1 and in the cross section of a machine which contains two rubber strips engaging in channel profiles.

During processing thereof, the cardboard or corrugated cardboard sheet 10 lies on a punching plate 24 below a carrier plate 22 of thickness a of the punching machine 20, as shown in FIG. 2. The carrier plate 22 consists of a multilayer plywood plate 22, in which laser cuts 26 have been made in an arrangement which corresponds to the contours of the intended packagings, said laser cuts being designed to receive punching tools as so-called blade or cutting lines 30; often a number of packagings—up to fifty or sixty—are arranged in groups on such a cardboard or corrugated cardboard sheet 10.

Figure 4:
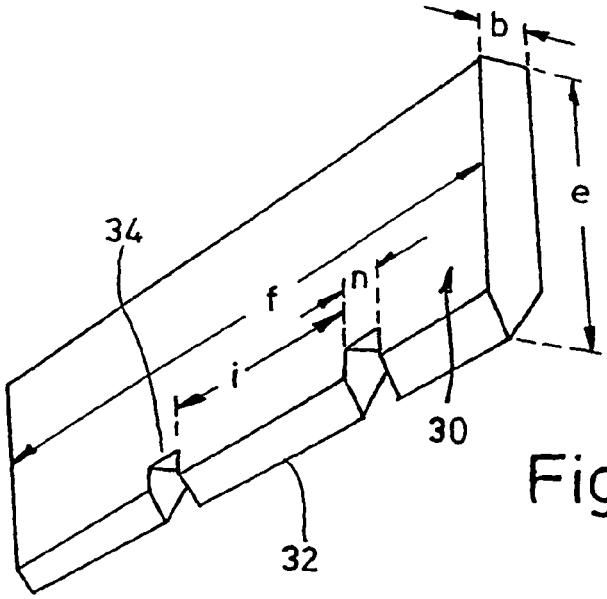
FIG. 4 shows part of a tool in an oblique view.

As shown in FIG. 4, the punching tool 30—which as already mentioned is referred to as a blade or cutting line—having for example a thickness b of 0.7 mm, a height e of in this case 24 mm and a length f of approximately 60 mm, is provided on its cutting edge 32 with notches or breaks 34 of length n of for example 1 mm, said notches being arranged at a distance i from one another and defining said supporting points 18 in a cutting line 16 produced in the sheet 10.

Figure 3:
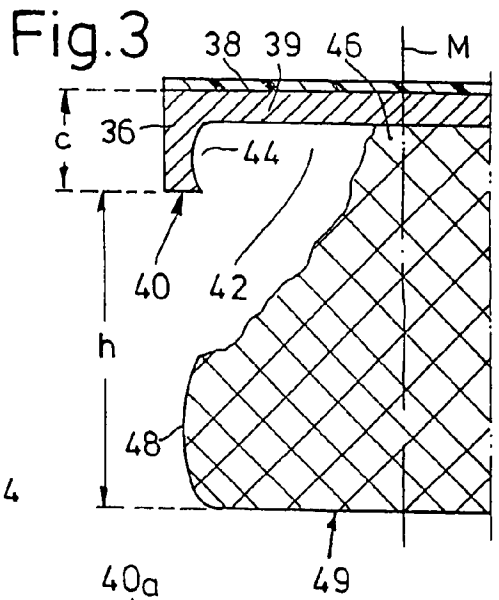
FIG. 3 shows an enlarged detail from FIG. 2.
Figure 5:
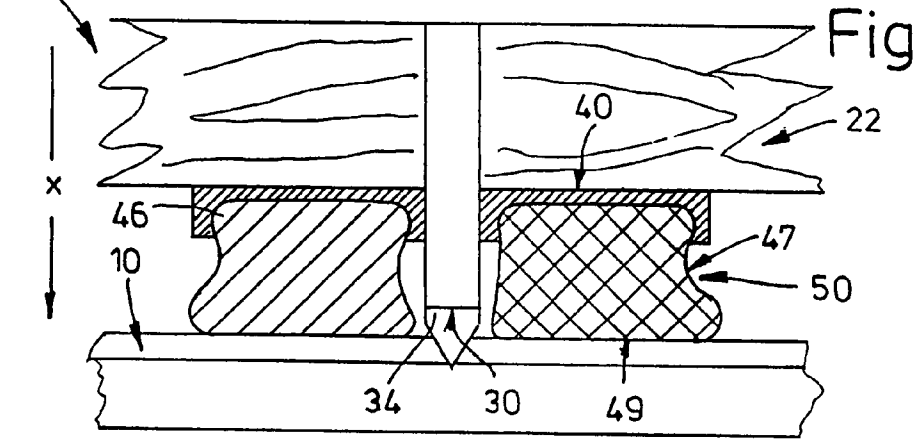
Figure 6:
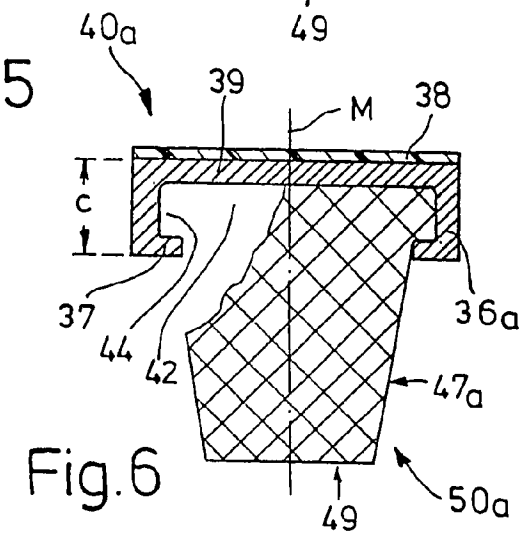
FIG. 6 shows an embodiment of a channel profile with rubber strips which has been modified compared to FIGS. 2, 3, 5.

The section of the punching tool 30 which projects from the plywood plate 22 is flanked on either side by channel profiles 40 having a height c of approximately 2 mm, said channel profiles being made from metal, in particular light metal, from plastic or ceramic. The width q of the channel profiles 40 in this case measures approximately 12 mm. The channel legs 36 of the channel profile 40, which as shown in FIGS. 3, 6 is adhesively bonded to the plywood plate 22 by an adhesive layer 38, define a channel space 42 and are curved on the inside in cross section in FIGS. 2, 3, 5—to form in each case a lateral undercut space 44—in order to hold in a clamping manner the ridge region 46 of a rubber profile 50 which has a corresponding shape in cross section, said rubber profile having an almost rectangular cross section with a free height h. The side surfaces 47 of said rubber profile are curved away from the ridge region 46 in cross section, a little towards the profile centre line M and also further downwards and outwards, so that a type of base bead 48 is produced close to the profile base surface 49 on either side.

During the punching operation, the base surfaces 49 of the rubber profiles 50, which are guided in the pressure direction x, are placed on the sheet 10 on either side of the corresponding punching contour 16—with the profile cross section being changed (FIG. 4). When the cutting lines 30 penetrate into the sheet material, huge wedge forces are produced which destroy the supporting points 18. By applying the rubber profiles 50 on either side of the punching tool 30, the pressure thereof gives rise to higher frictional resistance between the underside of the sheet 10 and the surface of the punching plate 24, and this prevents bursting of the supporting points 18. The cross section of the rubber profile 50 is in this case selected such that forces additionally act in the direction of the punching tool 30.

FIG. 6 shows a channel profile $\mathbf{40}_a$ with channel legs $\mathbf{36}_a$ which are bent inwards in an angled manner on either side, the hook bars 37 of which, parallel to the ridge plate 39 of the channel profile $\mathbf{40}_a$, delimit the undercut space 44. The rubber profile $\mathbf{50}_a$ in this case has two side surfaces $\mathbf{47}_a$ which are inclined inwards towards the centre line M thereof.

The rubber profiles 50 and $\mathbf{50}_a$ seated in the glued-on channel profiles 40 and $\mathbf{40}_a$ are simple to remove and replace. A rapid change to different—e.g. softer—rubber materials is also possible.

The invention claimed is:

1. A device for punching blanks from flat sheet comprising:

a carrier plate having a bottom surface;

a tool having longitudinal sides, the tool being mounted in the carrier plate and having a cutting edge which projects beyond the bottom surface of the carrier plate, the tool extending in a direction from the carrier plate to the cutting edge;

a pair of channel profiles, each fixed to the carrier plate on one longitudinal side of the tool;

a strip of flexible material mounted in each channel profile, wherein each strip projects away from the bottom surface of the carrier plate beyond the cutting edge of the tool when the tool is in a non-working position;

wherein each channel profile has a base fixed to the carrier plate and two legs extending away from the base in the direction of the tool, wherein each leg is provided with an inner undercut space, wherein the inner undercut space of the legs are curved inwards in cross section;

wherein each strip of flexible material has two side surfaces, wherein at least one side surface of the strip has an outwardly directed base bead and a ridge, wherein the tool is flanked on both sides by the base bead on the strips, and wherein the ridge engages with the inner undercut space.

2. The device as claimed in claim 1, wherein said carrier plate comprises wood.

3. The device as claimed in claim 2, wherein the base of the channel profile is fixed by a liquid adhesive.

4. The device as claimed in claim 3, wherein the base of the channel profile is provided with an adhesive layer.

5. The device as claimed in claim 4, wherein the adhesive layer is covered by a covering layer when not in use.

6. The device as claimed in claim 1, wherein said cutting edge is provided with notches made at a distance (i) from one another.

7. The device as claimed in claim 1, wherein the pair of channels comprise a rigid material defining the pair of channels.

8. The device as claimed in claim 1, wherein the strip of flexible material is inserted removably in each channel profile.

9. The device as claimed in claim 1, wherein said channel profiles are made of plastic.

10. A device for punching blanks from flat sheet comprising:

a carrier plate having a bottom surface;

a tool having two longitudinal sides, the tool being mounted in the carrier plate and having a cutting edge which projects beyond the bottom surface of the carrier plate, the tool extending in a direction from the carrier plate to the cutting edge;

a pair of channel profiles, each fixed to the carrier plate on one longitudinal side of the tool;

a strip of flexible material mounted in each channel profile, wherein each strip projects away from the bottom surface of the carrier plate beyond the cutting edge of the tool when the tool is in a non-working position;

wherein each channel profile has a base fixed to the carrier plate and two legs extending away from the base in the direction of the tool, wherein the strip has two side surfaces inclining inwards towards a profile center line (M) so as to define a large base and a small base; wherein the center line (M) of the strip is a line of symmetry thereof and extends in the direction of the tool; and wherein the legs have hook bars at their ends, said hook bars pointing towards one another, wherein the large base of the strip has two ridges engaging with the hook bars.

11. The device as claimed in claim 10, wherein said carrier plate comprises wood.

12. The device as claimed in claim 11, wherein the base of the channel profile is fixed by a liquid adhesive.

13. The device as claimed in claim 12, wherein the base of the channel profile is provided with an adhesive layer.

14. The device as claimed in claim 13, wherein the adhesive layer is covered by a covering layer when not in use.

15. The device as claimed in claim 10, wherein said cutting edge is provided with notches made at a distance (i) from one another.

16. The device as claimed in claim 10, wherein the pair of channels comprise a rigid material defining the pair of channels.

17. The device as claimed in claim 10, wherein the strip of flexible material is inserted removably in each channel profile.

18. The device as claimed in claim 10, wherein said channel profiles are made of plastic.

* * * * *